US010882310B2

(12) United States Patent
Anderson et al.

(10) Patent No.: US 10,882,310 B2
(45) Date of Patent: Jan. 5, 2021

(54) ON-DIE ACTUATOR EVALUATION

(71) Applicant: HEWLETT-PACKARD DEVELOPMENT COMPANY, L.P., Spring, TX (US)

(72) Inventors: Daryl E Anderson, Corvallis, OR (US); Eric Martin, Corvallis, OR (US); James Michael Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/473,756

(22) PCT Filed: Apr. 5, 2017

(86) PCT No.: PCT/US2017/026159
§ 371 (c)(1),
(2) Date: Jun. 26, 2019

(87) PCT Pub. No.: WO2018/186856
PCT Pub. Date: Oct. 11, 2018

(65) Prior Publication Data

US 2020/0016888 A1 Jan. 16, 2020

(51) Int. Cl.
*B41J 2/045* (2006.01)
*B41J 2/14* (2006.01)

(52) U.S. Cl.
CPC ..... *B41J 2/0451* (2013.01); *B41J 2/04541* (2013.01); *B41J 2/0458* (2013.01); (Continued)

(58) Field of Classification Search
CPC ..... B41J 2/0458; B41J 2002/14354; B41J 2/04541; B41J 2/0451; B41J 2/14153; (Continued)

(56) References Cited

U.S. PATENT DOCUMENTS 9,452,604 B2 9/2016 Van Brocklin et al.
9,457,560 B2 10/2016 Ready et al.
(Continued)

FOREIGN PATENT DOCUMENTS

CN 104080609 10/2014
CN 104169091 11/2014
(Continued)

OTHER PUBLICATIONS

"HP Pagewide Techndogy" http://www8.hp.com/ie/en/pdf/HP_PageWide_Technology_Whitepaper_tcm_147_1373163.pdf>, Dec. 2012.

*Primary Examiner* — Jannelle M Lebron
(74) *Attorney, Agent, or Firm* — Fabian VanCott

(57) ABSTRACT

In one example in accordance with the present disclosure, a fluid ejection die is described. The die includes a number of actuators to manipulate fluid. The actuators are disposed on the fluid ejection die and are grouped as primitives on the fluid ejection die. The fluid ejection die also includes a number of actuators sensors disposed on the fluid ejection die. The nozzle sensors receive a sense voltage indicative of a state of corresponding actuators. Each actuator sensor is coupled to a respective actuator. The fluid ejection die also includes an actuator evaluation device per primitive, which actuator evaluation device is disposed on the fluid ejection die. The actuator evaluation device evaluates an actuator characteristic of any actuator within the primitive and generates an output indicative of a failing actuator of the fluid ejection die.

18 Claims, 5 Drawing Sheets

(52) U.S. Cl.
CPC ..... *B41J 2/04543* (2013.01); *B41J 2/04573* (2013.01); *B41J 2/14153* (2013.01); *B41J 2002/14354* (2013.01)

(58) Field of Classification Search
CPC B41J 2/04543; B41J 2/04573; B41J 2/04581; B41J 2/2142
See application file for complete search history.

(56) References Cited

U.S. PATENT DOCUMENTS

| | | | | |
|---|---|---|---|---|
| 9,493,002 | B2 | 11/2016 | Edelen et al. | |
| 2008/0316277 | A1 | 12/2008 | Edelen et al. | |
| 2011/0084997 | A1 | 4/2011 | Chen et al. | |
| 2013/0278656 | A1 | 10/2013 | Govyadinov | |
| 2015/0062211 | A1* | 3/2015 | Tamura | B41J 2/0451 347/9 |
| 2017/0021626 | A1 | 1/2017 | Ge et al. | |
| 2017/0028724 | A1 | 2/2017 | Edelen et al. | |

FOREIGN PATENT DOCUMENTS

| | | |
|---|---|---|
| CN | 105939858 | 9/2016 |
| CN | 106255597 | 12/2016 |
| KR | 20120125908 | 11/2012 |
| WO | WO-2012003218 | 1/2012 |
| WO | WO-2015167561 A1 | 11/2015 |
| WO | WO-16066728 | 5/2016 |
| WO | WO-16175740 | 11/2016 |

* cited by examiner

ON-DIE ACTUATOR EVALUATION

BACKGROUND

A fluid ejection die is a component of a fluid ejection system that includes a number of nozzles. The die can also include other actuators such as micro-recirculation pumps. Through these nozzles and pumps, fluid, such as ink and fusing agent among others, is ejected or moved. Over time, these nozzles and actuators can become clogged of otherwise inoperable. As a specific example, ink in a printing device can, over time, harden and crust. This can block the nozzle and interrupting the operation of subsequent ejection events. Other examples of issues affecting these actuators include fluid fusing on an ejecting element, particle contamination, surface puddling, and surface damage to die structures. These and other scenarios may adversely affect operations of the device in which the die is installed.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1A:
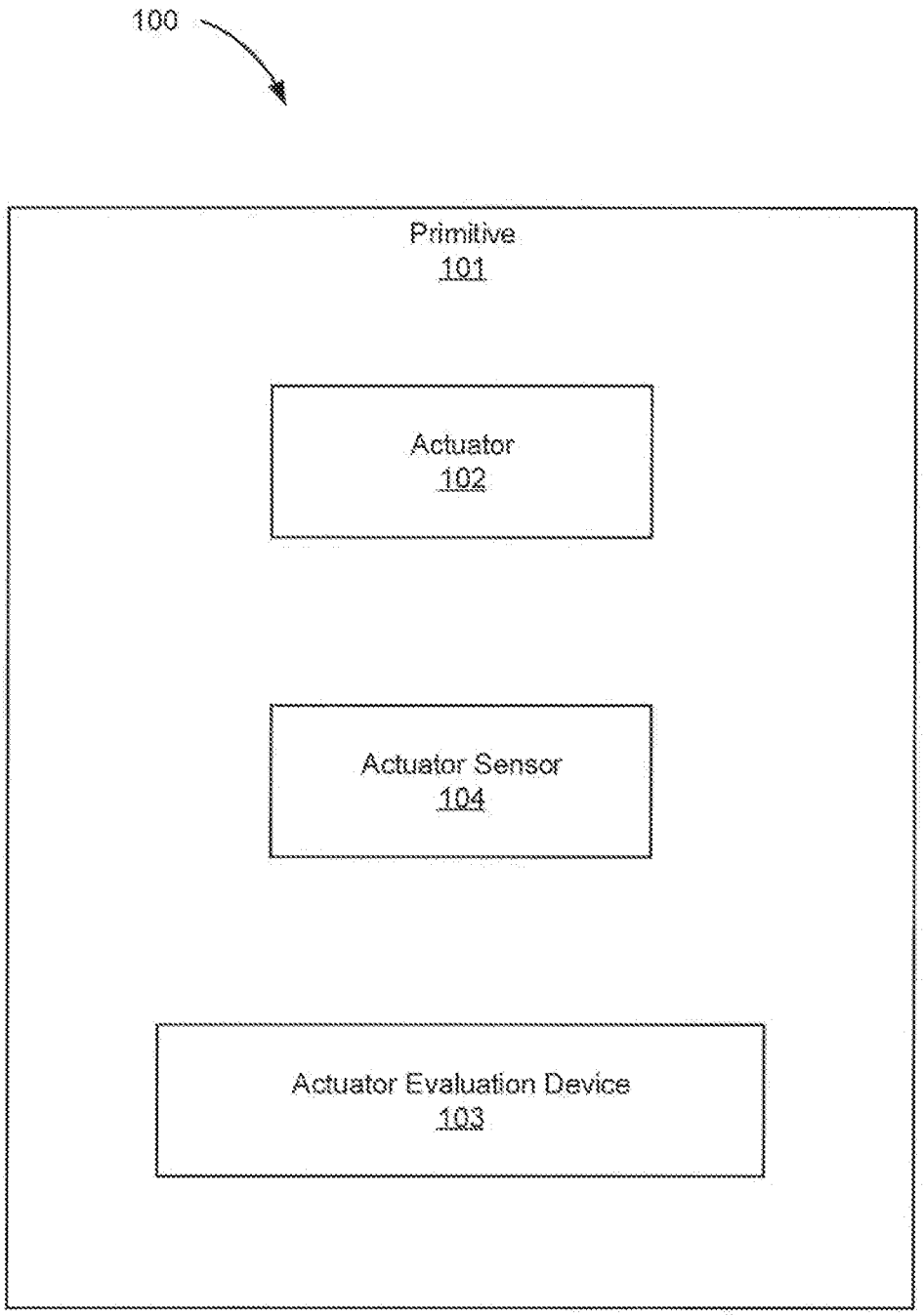
FIGS. 1A and 1B are block diagrams of a fluid ejection die including on-die actuator evaluation components, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

A fluid ejection die is a component of a fluid ejection system that includes a number of actuators. These actuators may come in the form of nozzles that eject fluid from a die, or non-ejecting actuators, such as recirculation pumps that circulate fluid throughout the fluid channels on the die. Through these nozzles and pumps, fluid, such as ink and fusing agent among others, is ejected or moved.

Specific examples of devices that rely on the fluid ejection systems include, but are not limited to, inkjet printers, multi-function printers (MFPs), and additive manufacturing apparatuses. The fluid ejection systems in these devices are widely used for precisely, and rapidly, dispensing small quantities of fluid. For example, in an additive manufacturing apparatus, the fluid ejection system dispenses fusing agents. The fusing agent is deposited on a build material, which fusing agent facilitates the hardening of build material to form a three-dimensional product.

Other fluid ejection systems dispense ink on a two-dimensional print medium such as paper. For example, during inkjet printing, ink is directed to a fluid ejection die. Depending on the content to be printed, the device in which the fluid ejection system is disposed determines the time and position at which the ink drops are to be released/ejected onto the print medium. In this way, the fluid ejection die releases multiple ink drops over a predefined area to produce a representation of the image content to be printed. Besides paper, other forms of print media may also be used.

Accordingly, as has been described, the systems and methods described herein may be implemented in a two-dimensional printing, i.e., depositing fluid on a substrate, and in three-dimensional printing, i.e., depositing a fusing agent or other functional agent on a material base to form a three-dimensional printed product.

To eject the fluid, these fluid ejection dies include nozzles and other actuators. Fluid is ejected from the die via nozzles and is moved throughout the die via other actuators, such as pumps. The fluid ejected through each nozzle comes from a corresponding fluid reservoir in fluid communication with the nozzle.

To eject the fluid, each nozzle includes various components. For example, a nozzle includes an ejector, an ejection chamber, and a nozzle orifice. An ejection chamber of the nozzle holds an amount of fluid. An ejector in the ejection chamber operates to eject fluid out of the ejection chamber, through the nozzle orifice. The ejector may include a thermal resistor or other thermal device, a piezoelectric element, or other mechanism for ejecting fluid from the firing chamber.

While such fluid ejection systems and dies undoubtedly have advanced the field of precise fluid delivery, some conditions impact their effectiveness. For example, the actuators on a die are subject to many cycles of heating, drive bubble formation, drive bubble collapse, and fluid replenishment from a fluid reservoir. Over time, and depending on other operating conditions, the actuators may become blocked or otherwise defective. For example, particulate matter, such as dried ink or powder build material, can block the nozzle. This particulate matter can adversely affect the formation and release of subsequent printing fluid. Other examples of scenarios that may impact the operation of a printing device include a fusing of the printing fluid on the ejector element, surface pudding, and general damage to components within the nozzle. As the process of depositing fluid on a surface is a precise operation, these blockages can have a deleterious effect on print quality. If one of these actuators fails, and is continually operating following failure, then it may cause neighboring actuators to fail.

Accordingly, the present specification is directed to determining a state of a particular actuator and/or identifying when an actuator is blocked or otherwise malfunctioning. Following such an identification, appropriate measures such as actuator servicing and actuator replacement can be performed. Specifically, the present specification describes such components as being located on the die.

To perform such identification, a fluid ejection die of the present specification includes a number of actuator sensors disposed on the die itself, which sensors are paired with actuators. The actuator sensors generate a voltage that is reflective of a characteristic of the actuator. From this output voltage, an actuator evaluation device can evaluate the actuator to determine whether it is functioning as expected or not.

Specifically, the present specification describes a fluid ejection die that includes a number at actuators to manipulate fluid. The number of actuators are disposed on the fluid ejection die and are grouped as primitives on the fluid ejection die. The fluid ejection die also includes a number of actuator sensors disposed on the fluid ejection die. The number of actuator sensors output a first voltage indicative of state of a corresponding actuator. Each actuator sensor is coupled to a respective actuator. The fluid ejection die also includes an actuator evaluation device per primitive disposed on the fluid ejection die to 1) evaluate an actuator characteristic of any actuator within the primitive and 2) generate an output indicative of a failing actuator of the fluid ejection die.

The present specification also describes a method for evaluating actuator characteristics of actuators on a fluid ejection die. According to the method, an activation pulse for activating an actuator of a primitive is received and the actuator is activated based on the activation pulse. The activation event generates a first voltage output by a corresponding actuator sensor. The corresponding actuator sensor is also disposed on the fluid ejection die and is coupled to the actuator. An actuator characteristic is then evaluated, at an actuator evaluation device shared by multiple actuators of the primitive, based at least in part on a comparison of the first voltage and a threshold voltage.

The present specification also describes a fluid ejection system that includes multiple fluid ejection dies. Each fluid ejection die includes a number of actuators to manipulate fluid. The number of actuators are disposed on the fluid ejection die and are grouped as primitives on the fluid ejection die.

Each fluid ejection die also includes a number of drive bubble detection devices, wherein each drive bubble detection device is coupled to one of the number of actuators. Each die also includes an actuator evaluation device coupled to a primitive to evaluate an actuator characteristic of the actuator based at least in part on a comparison of an output of a corresponding drive bubble detection device and a threshold voltage.

In this example, the actuator sensor and actuator evaluation device are disposed on the fluid ejection die itself as opposed to being off die, for example as a part of printer circuitry or other fluid ejection system circuitry. When such actuator evaluation circuitry is not on the fluid ejection die, gathered information from an actuator sensor is passed off die where it is used to determine a state of the corresponding actuator. Accordingly, by incorporating these elements directly on the fluid ejection die, increased technical functionality of a fluid ejection die is enabled. For example, printer-die communication bandwidth is reduced when sensor information is not passed off-die, but is rather maintained on the fluid ejection die when evaluating an actuator. On-die circuitry also reduces the computational overhead of the printer in which the fluid ejection die is disposed. Having such actuator evaluation circuitry on the fluid ejection die itself removes the printer from managing actuator service and/or repair and localizes it to the die itself. Additionally, by not locating such sensing and evaluation circuitry off-die, but maintaining it on the fluid ejection die, there can be faster responses to malfunctioning actuators. Still further, positioning this circuitry on the fluid ejection die reduces the sensitivity of these components to electrical noise that could corrupt the signals if they were driven off the fluid ejection die.

In one example, using such a fluid ejection die 1) allows for actuator evaluation circuitry to be included on a die as opposed to sending sensed signals to actuator evaluation circuitry off die; 2) increases the efficiency of bandwidth usage between the device and die; 3) reduces computational overhead for the device in which the fluid ejection die is disposed; 4) provides improved resolution times for malfunctioning actuators; 5) allows for actuator evaluation in one primitive while allowing continued operation of actuators in another primitive; and 6) places management of nozzles on the fluid ejection die as opposed to on the printer in which the fluid ejection die is installed. However, it is contemplated that the devices disclosed herein may address other matters and deficiencies in a number of technical areas.

As used in the present specification and the appended claims, the term "actuator" refers a nozzle or another non-ejecting actuator. For example, a nozzle, which is an actuator, operates to eject fluid from the fluid ejection die. A recirculation pump, which is an example of a non-ejecting actuator, moves fluid through the fluid slots, channels, and pathways within the fluid ejection die.

Accordingly, as used in the present specification and in the appended claims, the term "nozzle" refers to an individual component of a fluid ejection die that dispenses fluid onto a surface. The nozzle includes at least an ejection chamber, an ejector, and a nozzle orifice.

Further, as used in the present specification and in the appended claims, the term "fluid ejection die" refers to a component of a fluid ejection device that includes a number of nozzles through which a printing fluid is ejected. Groups of nozzles are categorized as "primitives" of the fluid ejection die. In one example, a primitive may include between 8-16 nozzles. The fluid ejection die may be organized first into two columns with 30-150 primitives per column.

Even further, as used in the present specification and in the appended claims, the term "a number of" or similar language is meant to be understood broadly as any positive number including 1 to infinity.

Figure 1B:
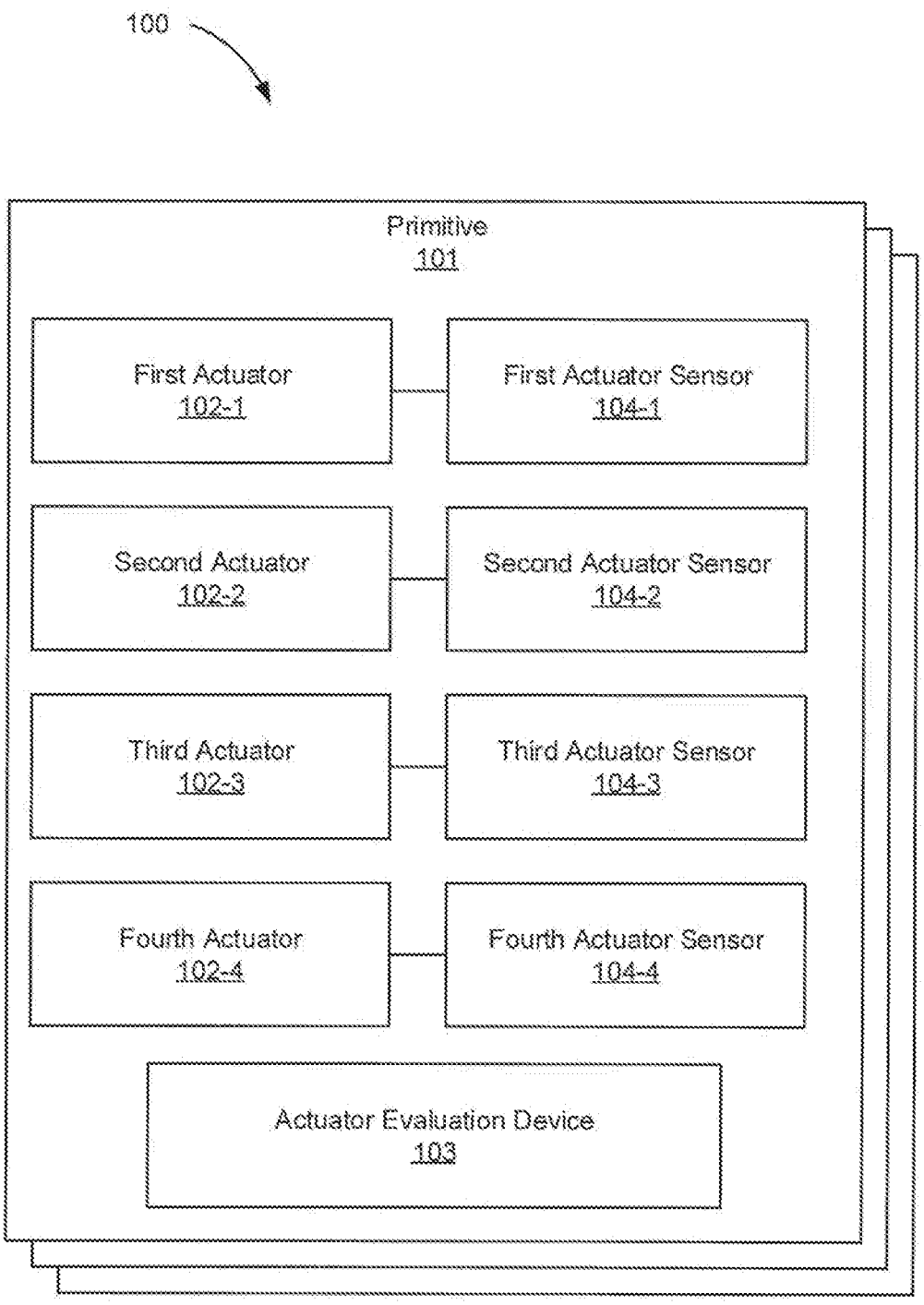

FIGS. 1A and 1B are block diagrams of a fluid ejection die (100) including on-die actuator evaluation components, according to an example of the principles described herein. As described above, the fluid ejection die (100) is a component of a fluid ejection system that houses components for ejecting fluid and/or transporting fluid along various pathways. The fluid that is ejected and moved throughout the fluid election die (100) can be of various types including ink, biochemical agents, and/or fusing agents.

FIG. 1A depicts a fluid ejection die (100) with an actuator (102), an actuator sensor (104), and an actuator evaluation device (103) disposed on a primitive (101). FIG. 1B depicts a fluid ejection die (100) with multiple actuators (102), multiple actuator sensor (104), and an actuator evaluation device (103) disposed on each primitive (103).

The fluid ejection die (100) includes various actuators (102) to eject fluid from the fluid ejection die (100) or to otherwise move fluid throughout the fluid ejection die (100). In some cases there may be one actuator (102) as depicted in FIG. 1A, in other examples there may be multiple actuators (102-1, 102-2, 102-3, 102-4) as depicted in FIG. 1B. The actuator (102) may be of varying types. For example, nozzles are one type of actuator (102) that eject fluid from the fluid ejection die (100). Another type of actuator (102) is a recirculation pump that moves fluid between a nozzle channel and a fluid slot that feeds the nozzle channel. While the present specification may make reference to a particular type of actuator (102), the fluid ejection die (100) may include any number and type of actuators (102). Also, within the figures the indication "-*"

refers to a specific instance of a component. For example, a first actuator is identified as (102-1). By comparison, the absence of an indication "-*" refers to the component in general. For example, an actuator in general is referred to as an actuator (102).

Returning to the actuators (102). A nozzle is a type of actuator that ejects fluid originating in a fluid reservoir onto a surface such as paper or a build material volume. Specifically, the fluid ejected by the nozzles may be provided to the nozzle via a fluid feed slot in the fluid ejection die (100) that fluidically couples the nozzles to a fluid reservoir. In order to eject the fluid, each nozzle includes a number of components, including an ejector, an ejection chamber, and a nozzle orifice. An example of an ejector, ejection chamber, and a nozzle orifice are provided below in connection with FIG. 3B.

The fluid ejection die (100) also includes actuator sensors (104) disposed on the fluid ejection die (100). In some cases there may be one actuator sensor (104) as depicted in FIG. 1A, in other examples there may be multiple actuator sensors (104-1, 104-2, 104-3, 104-4) as depicted in FIG. 1B. The actuator sensors (104) sense a characteristic of a corresponding actuator. For example, the actuator sensors (104) may measure an impedance near an actuator (102). As a specific example, the actuator sensors (104) may be drive bubble detectors that detect the presence of a drive bubble within an ejection chamber of a nozzle.

A drive bubble is generated by an ejector element to move fluid in the ejection chamber. Specifically, in thermal inkjet printing, a thermal ejector heats up to vaporize a portion of fluid in an ejection chamber. As the babble expands, it forces fluid out of the nozzle orifice. As the bubble collapses, a negative pressure within the ejection chamber draws fluid from the fluid feed slot of the fluid ejection die (100). Sensing the proper formation and collapse of such a drive bubble can be used to evaluate whether a particular nozzle is operating as expected. That is, a blockage in the nozzle will affect the formation of the drive bubble. If a drive bubble has not formed as expected, it can be determined that the nozzle is blocked and/or not working in the intended manner.

The presence of a drive bubble can be detected by measuring impedance values within the ejection chamber at different points in time. That is, as the vapor that makes up the drive bubble has a different conductivity than the fluid that otherwise is disposed within the chamber, when a drive bubble exists in the ejection chamber, a different impedance value will be measured. Accordingly, a drive bubble detection device measures this impedance and outputs a corresponding voltage. As will be described below, this output can be used to determine whether a drive bubble is properly forming and therefore determining whether the corresponding nozzle or pump is in a functioning or malfunctioning state. This output can be used to trigger subsequent actuator (102) management operations. While description has been provided of an impedance measurement, other characteristics may be measured to determine the characteristic of the corresponding actuator (102).

As described above, in some examples such as that depicted in FIG. 1B, each actuator sensor (104) of the number of actuator sensors (104) may be coupled to a respective actuator (102) of the number of actuators (102). In one example, each actuator sensor (104) is uniquely paired with the respective actuator (102). For example, a first actuator (102-1) may be uniquely paired with a first actuator sensor (104-1). Similarly, the second actuator (102-2), third actuator (102-3), and fourth actuator (102-4) may be uniquely paired with the second actuator sensor (104-2), third actuator sensor (104-3), and fourth actuator sensor (104-4). Multiple pairings of actuators (102) and actuator sensors (104) may be grouped together in a primitive (101) of the fluid ejection die (100). That is, the fluid ejection die (100) may include any number of actuator (102)/actuator sensor (104) pairs grouped as primitives (101). Pairing the actuators (102) and actuator sensors (104) in this fashion increases the efficiency of actuator (102) management. While FIG. 1B depicts multiple actuators (102) and actuator sensors (104), a primitive (101) may have any number of actuator (102)/actuator sensor (104) pairs, including one, as depicted in FIG. 1A.

Including the actuator sensors (104) on the fluid election die (100), as opposed to some off die location such as on the printer, also increases efficiency. Specifically, it allows for sensing to occur locally, rather than off-die, which increases the speed with which sensing can occur.

The fluid ejection die (100) also includes an actuator evaluation device (103) per primitive (101). The actuator evaluation device (103) evaluates an actuator (102) based at least on an output of the actuator sensor (104). For example, a first actuator sensor (104-1) may output a voltage that corresponds to an impedance measurement within an ejection chamber of a first nozzle. This voltage may be compared against a threshold voltage, which threshold voltage delineates between an expected voltage with fluid present and an expected voltage with fluid vapor present in the election chamber.

As a specific example, a voltage lower than the threshold voltage may indicate that fluid is present, which fluid has a lower impedance than fluid vapor. Accordingly, a voltage higher than the threshold voltage may indicate that vapor is present, which vapor has a higher impedance than fluid. Accordingly, at a time when a drive bubble is expected, a voltage output from an actuator sensor (104) that is higher than, or equal to, the threshold voltage would suggest the presence of a drive bubble while a voltage output from an actuator sensor (104) that is lower than the threshold voltage would suggest the lack of a drive bubble. In this case, as a drive bubble is expected, but the first voltage does not suggest such a drive bubble current is forming, it can be determined that the nozzle under test has a malfunctioning characteristic. While a specific relationship, i.e., low voltage indicates fluid, high voltage indicates fluid vapor, has been described, any desired relationship can be implemented in accordance with the principles described herein.

In same examples, to properly determine whether an actuator (102) is functioning as expected, the corresponding actuator sensor (104) may take multiple measurements relating to the corresponding actuator (102), and the actuator evaluation device (103) may evaluate multiple measurement values before outputting an indication of the state of the actuator (102). The different measured values may be taken at different time intervals following a firing event. Accordingly, the different measured values are compared against different threshold voltages. Specifically, the impedance measurements that indicate a properly forming drive bubble are a function of time. For example, a drive bubble at its largest yields a highest impedance, then as the bubble collapses over time, the impedance measure drops, due to the reduced amount of air in the ejection chamber while it refills with fluid. Accordingly, the threshold voltage that indicates a properly forming drive bubble also changes over time. Comparing multiple voltage values against multiple threshold voltages following a firing event provides greater confidence in a determined state of a particular actuator (102).

As can be seen in FIGS. 1A and 1B, the actuator evaluation device (103) is per primitive (101). That is a single actuator evaluation device (103) is shared among ail the actuators (102) in the primitive (101).

Figure 2:
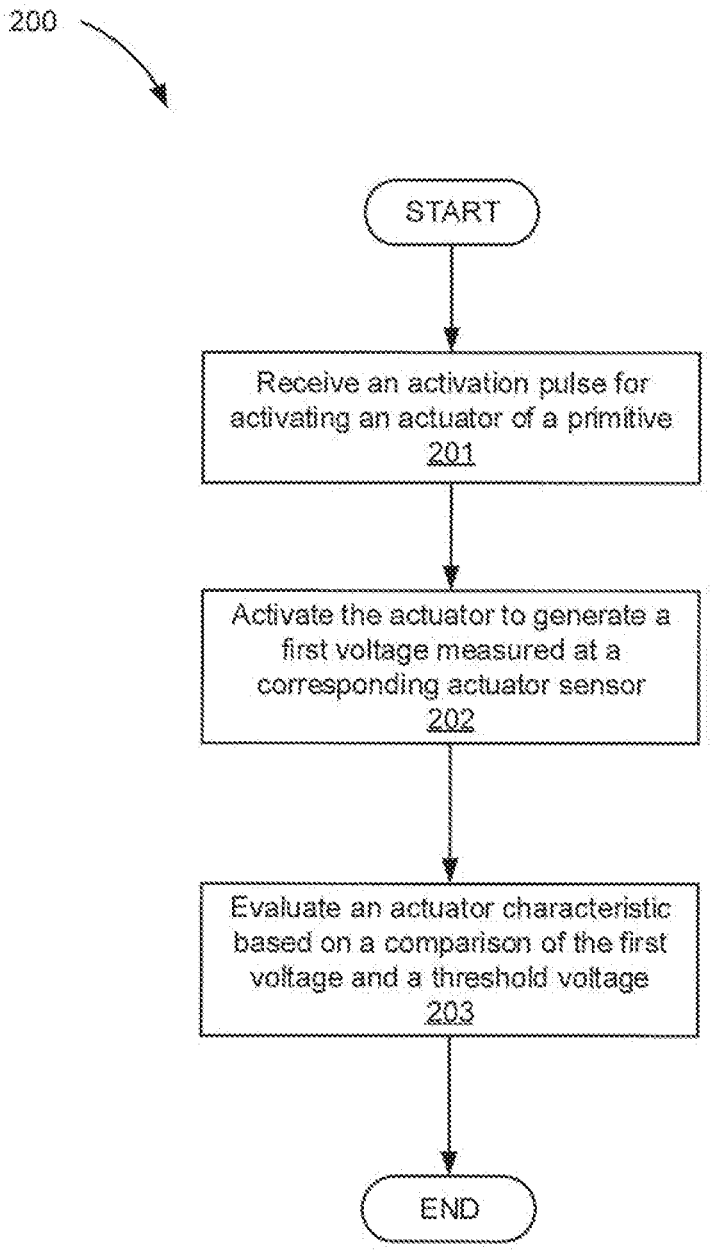
FIG. 2 is flowchart of a method for performing on-die actuator evaluation, according to an example of the principles described herein.

FIG. 2 is a flowchart of a method (200) for performing on-die actuator (FIG. 1A, 102) evaluation, according to an example of the principles described herein. According to the method (200), an activation pulse is received (block 201) at an actuator (FIG. 1A, 102). That is, a controller, or other off-die device, sends an electrical impulse that initiates an activation event. For a non-ejecting actuator, such as a recirculation pump, the activation pulse may activate a component to move fluid throughout the fluid channels and fluid slots within the fluid ejection die (FIG. 1A, 100). In a nozzle, the activation pulse may be a firing pulse that causes the ejector to eject fluid from the ejection chamber.

In a specific example of a nozzle, the activation pulse may include a pre-charge pulse that primes the ejector. For example, in the case of a thermal ejector, the pre-charge may warm up the heating element such that the fluid inside the ejection chamber is heated to a near-vaporization temperature. After a slight delay, a firing pulse is passed, which heats the heating element further so as to vaporize a portion of the fluid inside the ejection chamber. Receiving (block 201) the activation pulse at an actuator (FIG. 1A, 102) to be activated may include directing a global activation pulse to a particular actuator (FIG. 1A, 102). That is, the fluid ejection die (FIG. 1A, 100) may include an actuator select component that allows the global activation pulse to be passed to a particular actuator for activation. The actuator (FIG. 1A, 102) that is selected is part of a primitive. It may be the case, that one actuator (FIG. 1A, 102) per primitive may be fired at any given time.

Accordingly, the selected actuator (FIG. 1A, 102) is activated (block 202) based on the activation pulse. For example, in thermal inkjet printing, the heating element in a thermal ejector is heated so as to generate a drive bubble that forces fluid out the nozzle orifice. The firing of a particular nozzle (FIG. 1A, 102) generates a first voltage output by the corresponding actuator sensor (FIG. 1A, 104), which output is indicative of an impedance measure at a particular point in time within the election chamber. That is, each actuator sensor (FIG. 1A, 104) is coupled to, and in some cases, uniquely paired with, an actuator (FIG. 1A, 102). Accordingly, the actuator sensor (FIG. 1A, 104) that is uniquely paired with the actuator (FIG. 1A, 102) that has been fired outputs a first voltage.

To generate the first voltage, a current is passed to the single electrically conductive plate of the actuator sensor (FIG. 1A, 104), and from the plate, into the fluid or fluid vapor. For example, the actuator sensor (FIG. 1A, 104) may include a single tantalum plate disposed between the ejector and the ejection chamber. As this current is passed to the actuator sensor (FIG. 1A, 104) plate and from the plate, into the fluid or fluid vapor, an impedance is measured and a first voltage determined.

In some examples, activating (block 202) the actuator (FIG. 1A, 102) to obtain a first voltage for actuator evaluation may be carried out during the course of forming a printed mark. That is, the firing event that triggers an actuator evaluation may be a firing event to deposit fluid on a portion of the media intended to receive fluid. In other words, there is no dedicated operation relied on for performing actuator evaluation, and there would be no relics of the actuator evaluation process as the ink is deposited on a portion of an image that was intended to receive fluid as part of the printing operation.

In another example, the actuator (FIG. 1A, 102) is activated (block 202) in a dedicated event independent of a formation of a printed mark. That is, the firing event that triggers an actuator evaluation may be in addition to a firing event to deposit fluid on a portion of the media intended to receive fluid. That is, the actuator may fire over negative space on a sheet of media, and not one intended to receive ink to form an image.

An actuator characteristic is then evaluated (block 203) based at least in part on a comparison of the first voltage and the threshold voltage. In this example, the threshold voltage may be selected to clearly indicate a blocked, or otherwise malfunctioning, actuator (FIG. 1A, 102). That is, the threshold voltage may correspond to an impedance measurement expected when a drive bubble is present in the ejection chamber, i.e., the medium in the ejection chamber at that particular time is fluid vapor. Accordingly, if the medium in the ejection chamber were fluid vapor, then the received first voltage would be comparable to the threshold voltage. By comparison, if the medium in the ejection chamber is print fluid such as ink, which may be more conductive than fluid vapor, the impedance would be lower, thus a lower voltage would be present. Accordingly, the threshold voltage is configured such that a voltage lower than the threshold indicates the presence of fluid, and a voltage higher than the threshold indicates the presence of fluid vapor. If the first voltage is thereby greater than the threshold voltage, it may be determined that a drive bubble is present and if the first voltage is lower than the threshold voltage, it may be determined that a drive bubble is not present when it should be, and a determination made that the actuator (FIG. 1A, 102) is not performing as expected. While specific reference is made to output a low voltage to indicate low impedance, in another example, a high voltage may be output to indicate low impedance.

In some examples, the threshold voltage against which the first voltage is compared depends on an amount of time passed since the firing of the actuator (FIG. 1A, 102). That is, as the drive bubble collapses, the impedance in the ejection chamber changes over time, slowly returning to a value indicating the presence of fluid. Accordingly, the threshold voltage against which the first voltage is compared also changes over time.

Figure 3A:
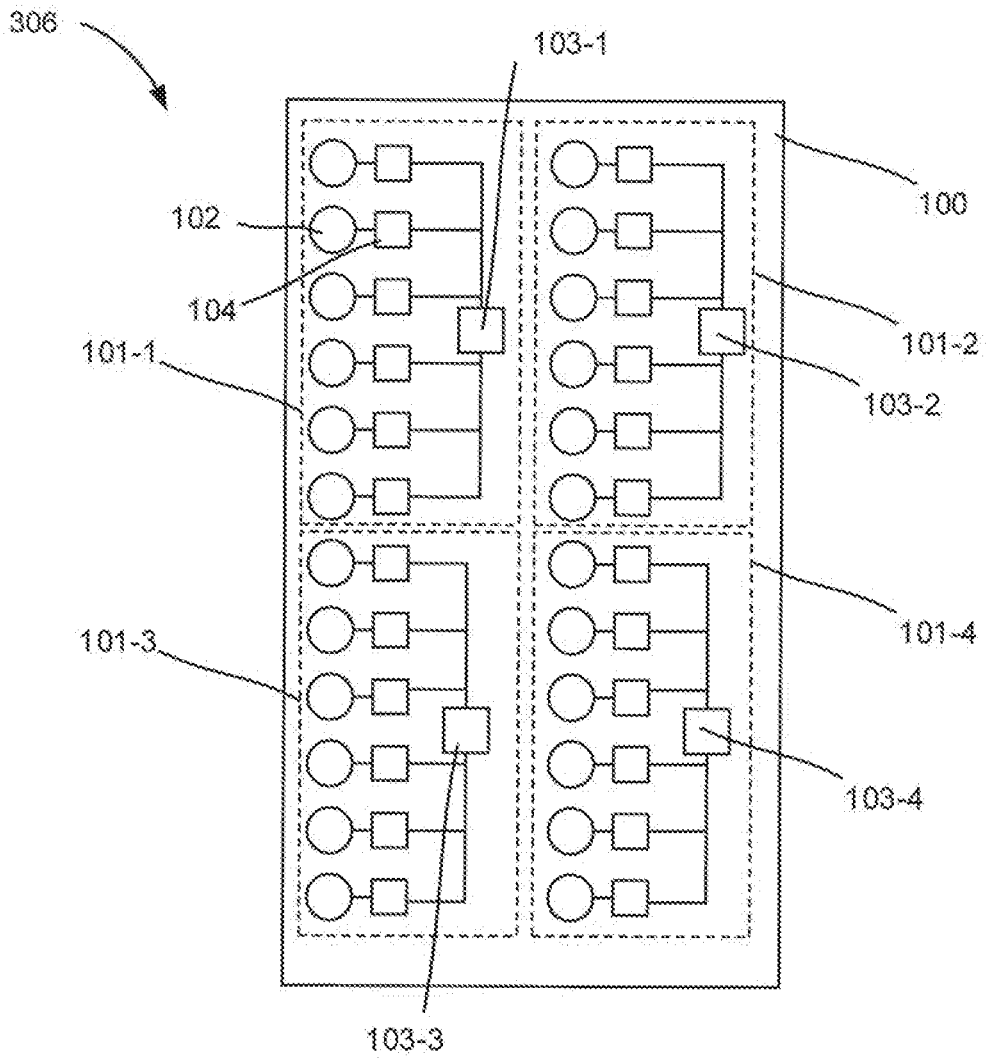
FIG. 3A is a block diagram of a fluid ejection system including on-die actuator evaluation components, according to an example of the principles described herein.

FIG. 3A is a block diagram of a fluid ejection system (306) including on-die actuator evaluation components, according to an example of the principles described herein. The system (306) includes a fluid ejection die (100) on which multiple actuators (102) and corresponding actuator sensors (104) are disposed. For simplicity, a single instance of an actuator (102) and a single instance of an actuator sensor (104) are indicated with reference numbers. However, a fluid ejection die (100) may include any number of actuators (102) and actuator sensors (104). In the example depicted in FIG. 3A, the actuators (102) and actuator sensors (104) are arranged into columns; however, the actuators (102) and actuator sensors (104) may be arranged in different arrays. The actuators (102) and actuator sensors (104) in each column may be grouped into primitives (101-1, 101-2, 101-3, 101-4). During printing, actuator (102) primitive (101) is activated at a time. While FIG. 3A depict six actuators (102) and six actuator sensors (104) per primitive (101), primitives (101) may have any number of actuators (102) and actuator sensors (104).

Figure 3B:
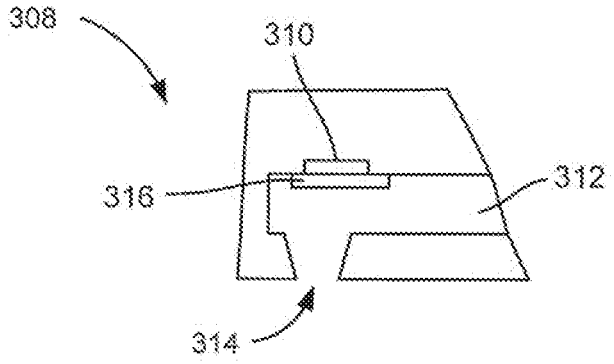
FIG. 3B is a cross-sectional diagram of a nozzle of the fluid ejection system depicted in FIG. 3A, according to an example of the principles described herein.

FIG. 3B is a cross sectional diagram of a nozzle (308). A nozzle (308) an actuator (102) that operates to eject fluid from the fluid ejection die (100) which fluid is initially disposed in a fluid reservoir that is fluidically coupled to the fluid ejection die (100). To eject the fluid, the nozzle (308) includes various components. Specifically, a nozzle (308) includes an ejector (310), an ejection chamber (312), and a nozzle orifice (314). The nozzle orifice (314) may allow fluid, such as ink, to be deposited onto a surface, such as a print medium. The ejection chamber (312) may hold an amount of fluid. The ejector (310) may be mechanism for ejecting fluid from the ejection chamber (312) through the nozzle office (314), where the ejector (310) may include a firing resistor or other thermal device, a piezoelectric element, or other mechanism for ejecting fluid from the ejection chamber (312).

In the case of a thermal inkjet operation, the ejector (310) is a heating element. Upon receiving the firing signal, the heating element initiates heating of the ink the ejection chamber (312). As the temperature of the fluid in proximity to the heating element increases, the fluid may vaporize and form a drive bubble. As the heating continues, the drive bubble expands and forces the fluid out of the nozzle orifice (314). As the vaporized fluid bubble pops, a negative pressure within the ejection chamber (312) draws fluid into the ejection chamber (312) from the fluid supply, and the process repeats. This system is referred to as a thermal inkjet system.

FIG. 3B also depicts a drive bubble detection device (316). The drive bubble detection device (316) depicted in FIG. 3B is an example of an actuator sensor (104) depicted in FIG. 3A. Accordingly, as with the actuator sensors (104), each drive bubble detection device (316) is coupled to a respective actuator (102) of the number of actuators (102) and the drive bubble detection devices (316) are part of a primitive (101) to which the corresponding actuator (102) is a component.

The drive bubble detection devices (316) may include a single electrically conductive plate, such as a tantalum plate, which can detect impedance of whatever medium is within the ejection chamber (312). Specifically, each drive bubble detection device (316) measures an impedance of the medium within the ejection chamber (312), which impedance measure can indicate whether a drive bubble is present in the ejection chamber (312). The drive bubble detection device (316) then outputs a first voltage value indicative of a state, i.e., drive bubble formed or not, of the corresponding nozzle (308). This output can be compared against a threshold voltage to determine whether the nozzle (308) is malfunctioning or otherwise inoperable.

Returning to FIG. 3A, the system (306) also includes a number of actuator evaluation devices (103-1, 103-2, 103-3, 103-4). Each of the actuator evaluation devices (103-1, 103-2, 103-3, 103-4) may be uniquely paired with a corresponding primitive (101-1, 101-2, 101-3, 101-4). That is a first primitive (101-1) may be uniquely paired with a first actuator evaluation device (103-1). Similarly, a second primitive (101-2), third primitive (101-3), and a fourth primitive (101-4) may be uniquely paired with a second actuator evaluation device (103-2), third actuator evaluation device (103-3), and fourth actuator evaluation device (103-4), respectively. In one example, each actuator evaluation device (103) corresponds to just the number of actuators (102) and just the number of actuator sensors (104) within that particular primitive (101).

The actuator evaluation devices (103) evaluate a characteristic of the actuators (102) within their corresponding primitive (101) based at least in part on an output of a actuator sensor (104) corresponding to the actuator (102), and a threshold voltage. That is, an actuator evaluation device (103) identifies a malfunctioning actuator (102) within its primitive (101). For example, as depicted above in regards to FIG. 2A, the threshold voltage may be such that a voltage lower than the threshold would indicate an actuator sensor (104) in contact with fluid vapor and a voltage higher than the threshold voltage would indicate an actuator sensor (104) that is in contact with fluid. Accordingly, per this comparison of the threshold voltage and the first voltage, it can be determined whether vapor or fluid is in contact with the actuator sensor (104) and accordingly, whether an expected drive bubble has been formed. While one particular relationship, i.e., low voltage indicating fluid and high voltage indicating vapor, has been presented, other relationships could exist, i.e., high voltage indicating fluid and low voltage indicating vapor.

Including the actuator evaluation device (318) on the fluid ejection die (100) improves the efficiency of actuator evaluation. For example, in other systems, any sensing information collected by an actuator sensor (104) is not per actuator (102), nor is it assessed on the fluid ejection die (100), but is rather routed off the fluid ejection die (100) to a printer, which increases communication bandwidth between the fluid ejection die (100) and the printer in which it is installed. Moreover such primitive/actuator evaluation device pairing allows for the localized "in primitive" assessment which can be used locally to disable a particular actuator, without involving the printer or the rest of the fluid ejection die (100).

Including an actuator evaluation device (103) per primitive (101) increases the efficiency of actuator evaluation. For example, were the actuator evaluation device (103) to be located off die, while one actuator (102) is being tested, all the actuators (102) on the die would be deactivated so as to not interfere with the testing procedure. However, where testing is done at a primitive (101) level, other primitives (101) of actuators (102) can continue to function to eject fluid. That is, an actuator (102) corresponding to the first primitive (101-1) may be evaluated while actuators (102) corresponding to the second primitive, (101-2), the third primitive (101-3), and the fourth primitive (101-4) may continue to operate to deposit fluid to form printed marks.

Moreover, including an actuator evaluation device (103) per primitive as opposed to per actuator (102) saves spaced, and is more efficient at determining actuator performance.

Following this comparison, the actuator evaluation devices (103) may generate an output indicative of a failing actuator of the fluid ejection die (100). This output may be a binary output, which could be used by downstream systems to carry out any number of operations.

Figure 4:
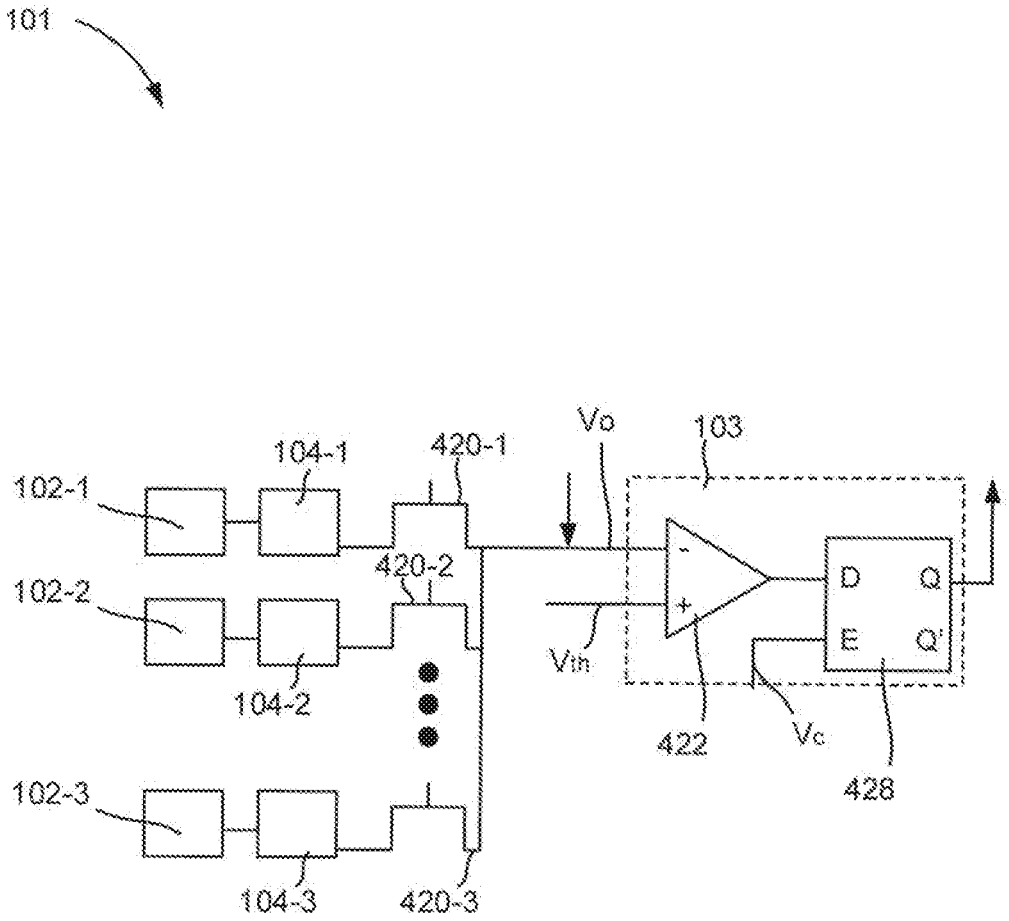
FIG. 4. Is a circuit diagram of on-die actuator evaluation components, according to another example of the principles described herein.

FIG. 4. Is a circuit diagram of on-die actuator evaluation components, according to another example of the principles described herein. Specifically, FIG. 4 is a circuit diagram of one primitive (101). As described above, the primitive (101) includes a number of actuators (102) and a number of actuator sensors (104) coupled to respective actuators (102). During operation, a particular actuator (102) is selected for activation. While active, the corresponding actuator sensor (104) is coupled to the actuator evaluation device (103) via a selecting transistor (420-1, 420-2, 420-3). That is, the selecting transistor couples the actuator evaluation device (103) and the selected actuator sensor (104). The coupling by the selecting transistor (420) also allows a current to pass through to the corresponding actuator sensor (104) such that an impedance measure of the ejection chamber (FIG. 3B, 312) within the nozzle (FIG. 3B, 308) can be made.

In this example, the actuator evaluation device (103) includes a compare device (422) to compare a voltage output, $V_o$, from one of the number of actuator sensors (104) against a threshold voltage, $V_{th}$, to determine when a corresponding actuator (102) is malfunctioning or otherwise inoperable. That is, the compare device (422) determines whether the output of the actuator sensor (104), $V_o$, is greater than or less than the threshold voltage, $V_{th}$. The compare device (422) then outputs a signal indicative of which is greater.

The output of the compare device (422) may then be passed to a storage device (428) of the actuator evaluation device (103). In one example, the storage device (428) may be a latch device that stores the output of the compare device (422) and selectively passes the output on. For example, the actuator sensor (104), the compare device (422), and the storage device (428) may be operating continuously to evaluate actuator characteristics and store a binary value relating to the state of the actuator (102). Then, when a control signal, $V_c$, is passed to enable the storage device (428), the information stored in the storage device (428) is passed on as an output from which any number of subsequent operations can be performed.

In some examples, the actuator evaluation device (103) may process multiple instances of a first voltage against multiple values of a threshold to determine whether an actuator (102) is blocked, or otherwise malfunctioning. For example, over multiple activation events, the first voltage may be sampled at different times relative to the activation event, corresponding to different phases of drive bubble formation and collapse. Each time the first voltage is sampled, it might be compared against a different threshold voltage. In this example, the actuator evaluation device (103) could either have unique latches to store the result of each comparison, or a single latch, and if the sensor voltage is ever outside of the expected range (given the time at which it was sampled), that actuator (102) can be identified as defective. In this case, single latch stores a bit which represents "aggregate" actuator status. In the case of multiple storage devices, each may store the evaluation result for a different sample time, and the aggregate collection of those bits can allow for the identification of not only the actuator state, but also the nature of the malfunction. Knowing the nature of the malfunction can inform the system as to the proper response (replace the nozzle, service the nozzle [i.e. multiple spits or pumps], clean the nozzle, etc.).

In one example, using such a fluid ejection die 1) allows for actuator evaluation circuitry to be included on a die as opposed to sending sensed signals to actuator evaluation circuitry off die; 2) increases the efficiency of bandwidth usage between the device and die; 3) reduces computational overhead for the device in which the fluid ejection die is disposed; 4) provides improved resolution times for malfunctioning actuators; 5) allows for actuator evaluation in one primitive while allowing continued operation of actuators in another primitive; and 6) places management of nozzles on the fluid ejection die as opposed to on the printer in which the fluid ejection die is installed. However, it is contemplated that the devices disclosed herein may address other matters and deficiencies in a number of technical areas.

The preceding description has been presented to illustrate and describe examples of the principles described. This description is not intended to be exhaustive or to limit these principles to any precise form disclosed. Many modifications and variations ere possible in light of the above teaching.

What is claimed is:

1. A fluid ejection die comprising:

a number of actuators to manipulate fluid, wherein the number of actuators:

are disposed on the fluid ejection die; and are grouped as primitives on the fluid ejection die;

a number of actuator sensors disposed inside a fluid channel on the fluid ejection die to receive a sense voltage indicative of a state of a corresponding actuator, wherein each actuator sensor is coupled to a respective actuator;

an actuator evaluation device per primitive disposed on the fluid ejection die to:

evaluate an actuator characteristic of any actuator within the primitive; and generate an output indicative of a failing actuator of the fluid ejection die.

2. The fluid ejection die of claim 1, wherein:

each actuator sensor is uniquely paired with a corresponding actuator; and a single actuator evaluation device is shared among all the actuators in the primitive.

3. The fluid ejection die of claim 1, wherein the actuator evaluation device corresponds to just the number of actuators and just the number of actuator sensors within the primitive.

4. The fluid ejection die of claim 1, wherein the number of actuator sensors are drive bubble detection devices to detect a presence of a drive bubble in a corresponding ejection chamber based on a measured impedance within the ejection chamber.

5. The fluid ejection die of claim 1, wherein an actuator in a first primitive is assessed while an actuator in a second primitive is ejecting fluid.

6. The method of claim 1, wherein the actuator is activated in a dedicated event independent of a formation of a printed mark.

7. The fluid ejection die of claim 1, wherein the actuator evaluation device comprises:

a compare device to compare a voltage output from one of the number of actuator sensors against a threshold voltage to determine when a corresponding actuator is malfunctioning; and a storage device to store the output of the compare device and to selectively pass the stored output off-die as indicated by a control signal.

8. The fluid ejection die of claim 7, wherein, following a single firing event, the compare device compares multiple outputs from one of the number of actuator sensors against multiple threshold voltages to determine when a corresponding actuator is malfunctioning.

9. The fluid ejection die of claim 7, wherein:

a voltage output lower than the threshold voltage indicates fluid is present; and a voltage output greater than the threshold voltage indicates that vapor is present.

10. The fluid ejection die of claim 7, wherein the threshold voltage is based on an amount of time passed since firing an associated actuator.

11. A method comprising:

receiving an activation pulse for activating an actuator of a primitive on a fluid ejection die;

activating the actuator based on the activation pulse to generate a first voltage measured at a corresponding actuator sensor, wherein the corresponding actuator sensor:

is disposed in an ejection chamber on the fluid ejection die; and is coupled to the actuator; and evaluating an actuator characteristic of the actuator at an actuator evaluation device shared by multiple actuators of the primitive and disposed on the fluid ejection die based at least in part on a comparison of the first voltage and a threshold voltage.

12. The method of claim 11, wherein the threshold voltage is selected to indicate an actuator performance.

13. The method of claim 11, wherein the threshold voltage against which the first voltage is compared varies with respect to an amount of time passed since the activation of the actuator.

14. The method of claim 11, further comprising activating the actuator sensor to measure the first voltage by passing a measurement current to a single electrically conductive plate of the actuator sensor.

15. The method of claim 11, wherein the first voltage is measured on the die in the course of forming a printed mark.

16. A fluid ejection system comprising:

multiple fluid ejection dies, wherein a fluid ejection die comprises:

a number of actuators to manipulate fluid, wherein the number of actuators:

are disposed on the fluid ejection die; and are grouped as primitives on the fluid ejection die; and a number of drive bubble detection devices, wherein each drive bubble detection device is:

coupled to one of the number of actuators; and a single electrically conductive plate disposed between an actuator and a fluid channel;

an actuator evaluation device disposed on the fluid ejection die to determine when a nozzle associated with the actuator is blocked based at least in part on a comparison of an output of a corresponding drive bubble detection device and a threshold voltage; and a transistor to selectively couple the actuator evaluation device to a selected drive bubble detection device.

17. The fluid ejection system of claim 16, wherein:

the fluid ejection system comprises multiple actuator evaluation devices; and each actuator evaluation device is uniquely paired with a corresponding primitive.

18. The fluid ejection system of claim 16, further comprising a storage device, disposed on the fluidic die, to store the output of the actuator evaluation device.

* * * * *